US007107721B2

(12) United States Patent
Sato

(10) Patent No.: US 7,107,721 B2
(45) Date of Patent: Sep. 19, 2006

(54) DOOR APPARATUS

(75) Inventor: Yoshinobu Sato, Kawasaki (JP)

(73) Assignee: Fuji Electric Co., Ltd., Kawasaki (JP)

( * ) Notice: Subject to any disclaimer, the term of this patent is extended or adjusted under 35 U.S.C. 154(b) by 4 days.

(21) Appl. No.: 10/647,117

(22) Filed: Aug. 25, 2003

(65) Prior Publication Data

US 2004/0163318 A1 Aug. 26, 2004

(30) Foreign Application Priority Data

Feb. 26, 2003 (JP) ..... 2003-048873

(51) Int. Cl.
*E05F 11/02* (2006.01)

(52) U.S. Cl. ..... 49/281; 49/280; 49/300

(58) Field of Classification Search ..... 49/279, 49/280, 281, 300, 138; 292/DIG. 23, 341.16; 70/277, 278.1, 278.2, 178.3, 279.1, 280–283, 70/283.1, 263, 266–270; 340/5.2
See application file for complete search history.

(56) References Cited

U.S. PATENT DOCUMENTS

| | | | | |
|---|---|---|---|---|
| 1,976,223 | A | 10/1934 | Hedley et al. | |
| 4,882,876 | A | 11/1989 | Daugirdas | |
| 4,901,474 | A | 2/1990 | Bayard et al. | |
| 5,640,807 | A * | 6/1997 | Shigematsu et al. | 49/449 |
| 5,755,060 | A | 5/1998 | Zweili | |
| 5,927,015 | A | 7/1999 | Ghosn et al. | |
| 6,588,829 | B1 * | 7/2003 | Long et al. | 296/155 |
| 6,739,646 | B1 * | 5/2004 | Suzuki et al. | 296/155 |
| 2003/0106457 | A1 | 6/2003 | Inage | |

FOREIGN PATENT DOCUMENTS

JP 10-193977 7/1998

OTHER PUBLICATIONS

"Development of linea motor driving system for commuter train", Yoshihiko Sato, Member, Keizi Kouzu (JR East), Hiroshi Harie, Member, Akio Inage (Fuji Electric).
"Development of Linear Motor Driving System for Commuter Train", Yoshihiko Sato et al, Proceedings of the 1999 Japan Industry Application Society Conference, vol. 1, pp. 359-362. (English translation of pp. 360-361 attached).

* cited by examiner

*Primary Examiner*—Jerry Redman
(74) *Attorney, Agent, or Firm*—Rabin & Berdo, PC

(57) ABSTRACT

The door apparatus has a linear motor for applying a thrust to move a door, a lock device for performing a locking operation and an unlocking operation, and a control unit for controlling the linear motor and the lock device. Upon determining that the lock device is still in a locked state after a set time has elapsed from initiation of the unlocking operation, the control unit controls the linear motor to apply a thrust force to the door while again controlling the lock device to perform the unlocking operation. As a result, even when the locking pin and the lock hole are misaligned to such an extent as to interfere with the unlocking operation, the unlocking operation can be performed without an increase in a thrust output by a solenoid of the lock device, the solenoid can be prevented from overheating and the size and weight of the solenoid can be reduced.

21 Claims, 7 Drawing Sheets

DOOR CLOSED

DOOR OPEN

DOOR CLOSED

DOOR APPARATUS

BACKGROUND OF THE INVENTION

This application claims foreign priority benefits of applicant's Japanese Patent Application Serial No. JP PA 2003–48873, the entire disclosure of which is incorporated herein by reference.

1. Field of the Invention

The invention relates to a door apparatus, which locks and unlocks a door when opening and closing the door.

2. Description of the Related Art

The construction of a door apparatus of the related art will be described with reference to the drawings. FIGS. 5A and 5B are schematic views of a door apparatus. FIG. 5A shows a door closed and FIG. 5B the door open. FIGS. 6A and 6B are views of a lock device. FIG. 6A shows a locked state and FIG. 6B shows an unlocked state. FIG. 7 is a flow chart showing a control algorithm for opening a door of the related art.

As shown in FIGS. 5A and 5B, the door apparatus has a door 1, a linear motor 2, a lock device 3, a control unit 4, stoppers 5, and a holder part 6.

The door 1 is constructed to move in opposite opening and closing directions (the left and right directions in FIGS. 5A and 5B) between a closed state shown in FIG. 5A and an open state shown in FIG. 5B. The direction in which the door 1 is opened (from the state shown in FIG. 5A to the state shown in FIG. 5B) will be called herein the opening direction, and the direction in which the door 1 is closed (from the state shown in FIG. 5B to the state shown in FIG. 5A) will be called the closing direction.

The linear motor 2 is one specific example of a door driving device, and applies a thrust or thrust force to the door 1 so that by door movement the door 1 moves and performs an opening operation or a closing operation.

The lock device 3, which will be further discussed later, is mechanically constructed selectively to perform a locking operation or an unlocking operation on the door 1.

The control unit 4 controls the linear motor 2 and the lock device 3 in accordance with door opening and closing instructions from a control part (not shown).

The stoppers 5 prevent the door 1 from suffering a strong shock even if the door 1 opens and closes energetically and hits the ends of its range of motion in its opening and closing directions.

As shown in detail in FIGS. 6A and 6B, the lock device 3 also has a holder part 6 (shown in FIGS. 5A and 5B), a locking pin 7, a solenoid 8, a locking pin mounting 9, and a locking sensor 10.

The holder part 6 is fixed to the door 1 (see FIGS. 5A, 5B), and has a lock hole 6*a* (see FIGS. 6A, 6B) into which the locking pin 7 can pass.

The locking pin 7 is inserted into the lock hole 6*a* of the holder part 6 to mechanically fix the door 1.

The solenoid 8 supplies a thrust for deploying or withdrawing the locking pin 7.

The locking pin mounting 9 mechanically connects a moving part of the solenoid 8 to the locking pin 7, and transmits the thrust from the solenoid 8 to the locking pin 7. The locking pin mounting 9 also allows a contact arm of the locking sensor 10 to move, as the locking pin mounting 9 moves up and down.

The locking sensor 10 is provided to check the position of the locking pin 7. As shown in FIG. 6A, when the locking pin is in the locked state, the locking sensor 10 outputs an ON-state signal because the locking pin mounting 9 has descended and lowered the contact arm. As shown in FIG. 6B, when the locking pin 7 is withdrawn from the lock hole 6*a* so that the lock device 3 is in the unlocked state, the locking sensor 10 outputs an OFF-state signal because the locking pin mounting 9 has ascended and allowed the contact arm to be raised. These ON-state and OFF-state signals are outputted to the control unit 4.

The operation of the lock device 3 when the door 1 is opened (moved from the closed state to the open state) will now be explained.

When the door 1 is closed, as shown in FIG. 6A, the locking pin 7 is inserted in the lock hole 6*a* of the holder part 6. When the locking sensor 10 detects this position of the locking pin 7, the sensor outputs a signal indicating that the sensor is in the ON state (corresponding to the locked state of the lock device 3). The control unit 4 detects the ON-state signal outputted from the locking sensor 10 and recognizes the locked state.

If the control unit 4 has received a door opening instruction for opening the door 1, the control unit 4 first controls the lock device 3 to shift from the locked state to the unlocked state, and then controls the linear motor 2 to open the door 1. This control now will be described. As shown by the flow in FIG. 7, the solenoid 8 is driven to perform an unlocking operation by lifting the locking pin 7 from the lock hole 6*a* (step S100).

Along with the locking pin 7, the locking pin mounting 9 also rises, and the lock device 3 assumes the unlocked state shown in FIG. 6B. In the unlocked state, the locking sensor 10 is in its OFF state, and outputs an OFF-state signal to the control unit 4. The control unit 4 always determines whether the locking sensor 10 has shifted to its OFF state (i.e. whether the signal outputted from the locking sensor 10 has shifted from the ON-state signal to the OFF-state signal) (step S101). When the control unit 4 does not detect the ON-state signal, it then infers that the unlocking operation has not been carried out and returns to step S100 before it drives the solenoid 8 again. When the control unit 4 has detected the OFF-state signal, it controls the linear motor 2 to apply a thrust force to the door 1 in the opening direction (step S102). The linear motor 2 then opens the door 1 to its open state (see FIG. 5B).

When the door 1 is to be closed, the control unit 4 performs the reverse operation. That is, it controls the linear motor 2 to apply a thrust force to the door 1 in the closing direction of the door 1 and controls the lock device 3 to perform a locking operation. Such is a door apparatus of the related art.

As another door apparatus, of the prior art, using a linear motor and a lock device, there is also the apparatus disclosed in JP-A-10-193977 (corresponding to U.S. Pat. No. 5,927,015), for example.

In the lock mechanism of the disclosed in JP-A-10-193977, which is described therein at Paragraph Numbers 0016 and 0017 and illustrated in FIGS. 4 through 7 thereof, a transfer rod 26 of a linear induction motor (LIM) actuator 25 holds a door panel 17 firmly in a closed position by moving a lock assembly 40 to a locked state.

As another example of the prior art, there is also the technology described in the non-patent publication "Development of Linear Motor Driven Door System for Commuter Train" published by Sato, Kouzu, Suzue, and Inage at pages 359–362 of the 1999 Electrical Engineering Society Industrial Application Section Conference Lecture Articles. As shown in FIG. 1 and FIG. 6 thereof, this non-patent publication describes a technology where a door system has a direction converting device for mechanically dividing a thrust generated by a single linear motor so as to open a double door, and a door locking device for locking and unlocking this direction-converting device.

In these prior art technologies, there is no consideration of a problem in the operation of the lock device. This problem will be described with reference to the drawings.

FIG. 8 is illustrates a problem of a lock device. In the locked state shown in FIG. 8, it sometimes happens that due to the state of mounting of the lock device 3 with respect to the door 1, or of the door 1 impacting with the stoppers 5, the center of the lock hole 6*a* may become misaligned with respect to the locking pin 7, so that they are relatively positioned such that in the locked state, the locking pin 7 and the cylindrical boundary surface of lock hole 6*a* make contact and create a frictional force.

In this case, there is the problem that it takes much longer than normal for the locking pin 7 to rise, and in bad cases the locking pin 7 does not rise at all.

Because of this kind of situation in the prior art, a solenoid 8 that produces a thrust force large enough to overcome the frictional force between the locking pin 7 and the boundary of the lock hole 6*a* has been used. However, this creates a problem that the size and cost of the apparatus increase.

When this problem state continues, the locking sensor 10 remains in its ON-state and the steps S100 and S101 of FIG. 7 are repeated. This also causes a problem that the solenoid 8 continues to be energized, thereby resulting in an overheating of the device.

OBJECTS AND SUMMARY OF THE INVENTION

The invention has been provided to solve the above problems. Therefore, an object of the invention is to provide a door apparatus with which, even when the locking pin and the lock hole interfere, the unlocking operation can be performed without an increase in the thrust produced by the solenoid, and thus the solenoid can be reduced in size and weight and prevented from overheating.

To achieve the above-mentioned object, the invention provides a door apparatus having a door movable in opposite opening and closing directions, a door driving device for applying a thrust force to the door to move the door, a lock device for performing a locking operation and an unlocking operation on the door, and a control apparatus for controlling the door driving device and the lock device, wherein if the control apparatus controls the lock device to perform the unlocking operation and the lock device is determined to be still in a locked state after a set time, the control apparatus controls the lock device to perform the unlocking operation again in such a manner as to open the door without increasing the applied thrust force.

According to a first aspect of the invention if the lock device is determined still to be in a locked state after the set time following the initial unlocking operation, the control apparatus controls the door driving device to apply a thrust force to the door in either the opening direction or the closing direction.

According to a second aspect of the invention, if the control apparatus controls the lock device to perform the unlocking operation and the lock device is determined still to be in a locked state after a set time, the control apparatus controls the lock device to perform the unlocking operation while controlling the door driving device to apply to the door a thrust force in both the opening direction and the closing direction.

A third aspect of the invention provides a door apparatus according to the first aspect wherein the control apparatus controls the door driving device to apply to the door a large thrust force and a small thrust force alternately in the same direction, and controls the lock device to perform the unlocking operation in synchrony with the timing of the changing of these large and small thrusts.

A fourth aspect of the invention provides a door apparatus according to the second aspect wherein the control apparatus controls the door driving device to apply to the door a thrust force in the opening direction and a thrust force in the closing direction alternately, and controls the lock device to perform the unlocking operation in synchrony with the timing of the changing between the opening direction and closing direction thrusts.

BRIEF DESCRIPTION OF DRAWINGS

These and other aspects and advantages of the invention will be more fully understood from the following detailed description of the preferred embodiments, wherein.

DETAILED DESCRIPTION OF THE PREFERRED EMBODIMENTS

Figure 1:
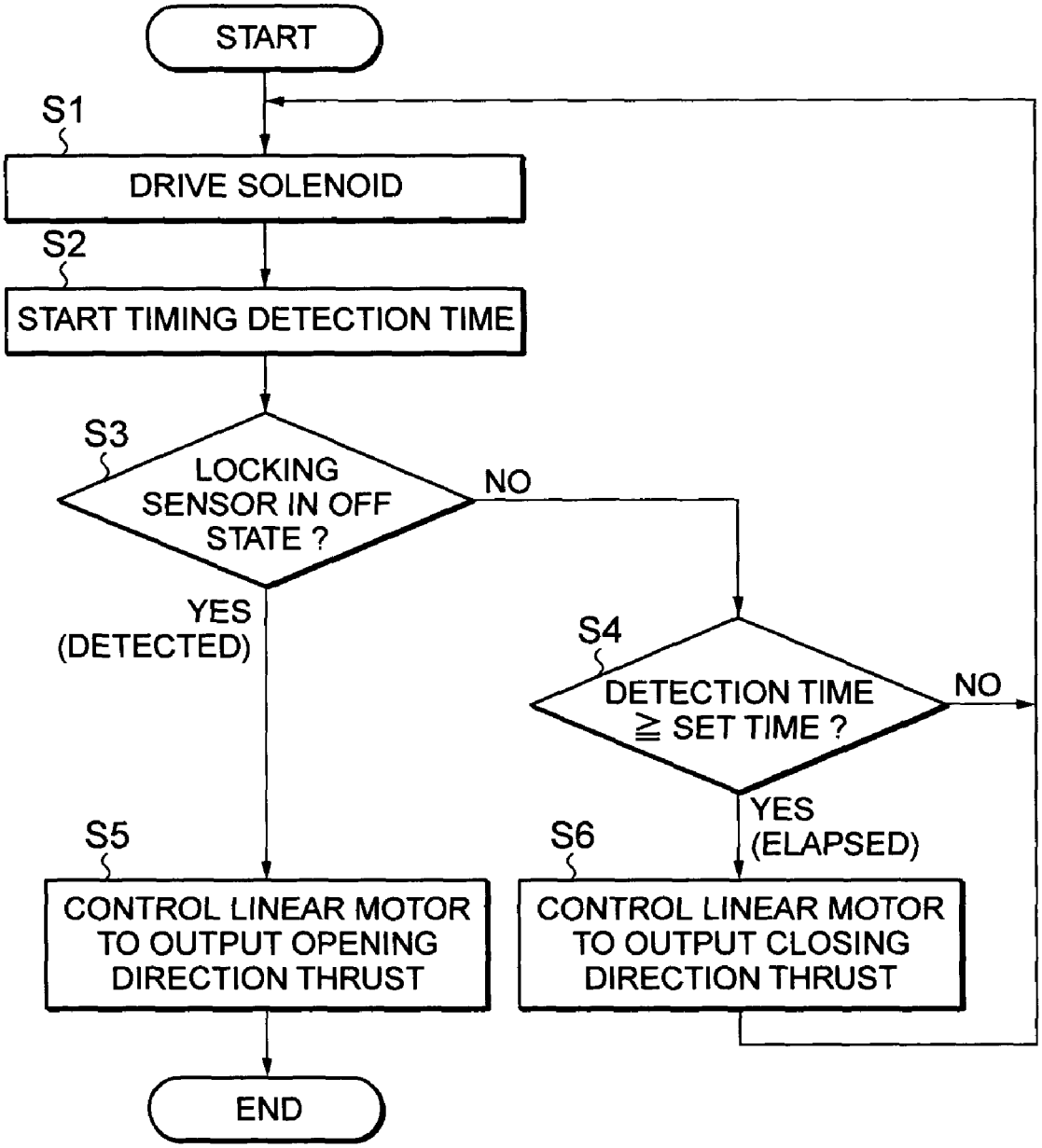
FIG. 1 is a flow chart showing a control algorithm of a first preferred embodiment of a door apparatus according to the invention.

Presently preferred embodiments of a door apparatus according to the invention now will be described below. FIG. 1 is a flow chart showing a control algorithm of a first preferred embodiment of a door apparatus according to the invention.

Figure 5B:
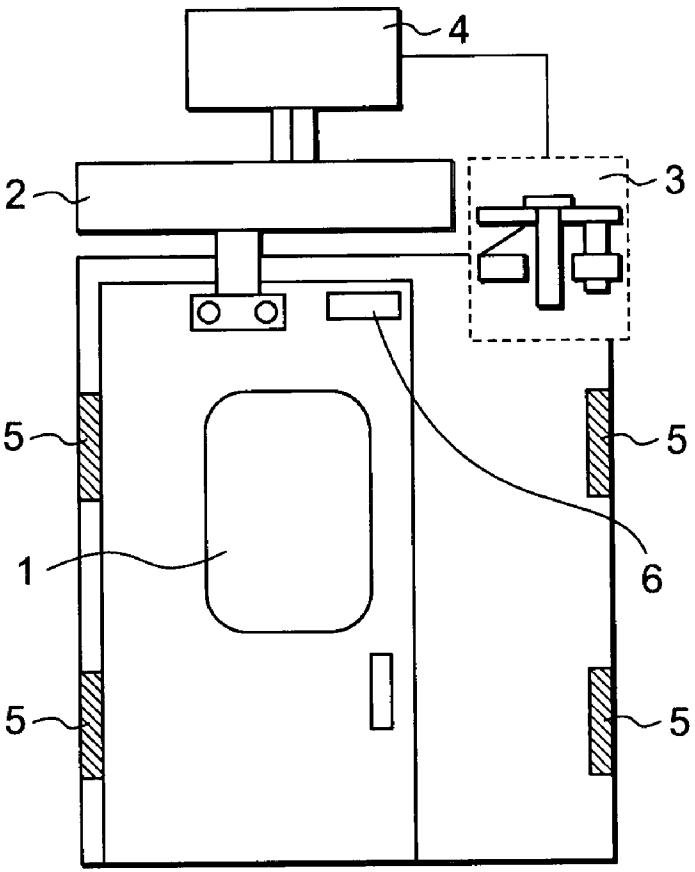
FIGS. 5A and 5B are schematic views of a door apparatus, FIG. 5A showing the door closed and FIG. 5B the door open.
Figure 5A:
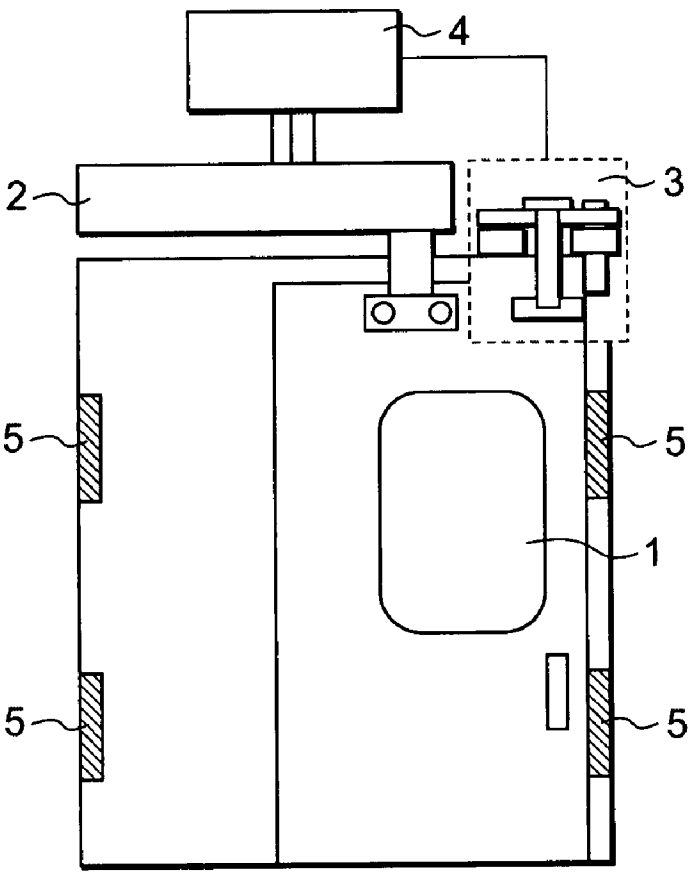
Figure 6A:
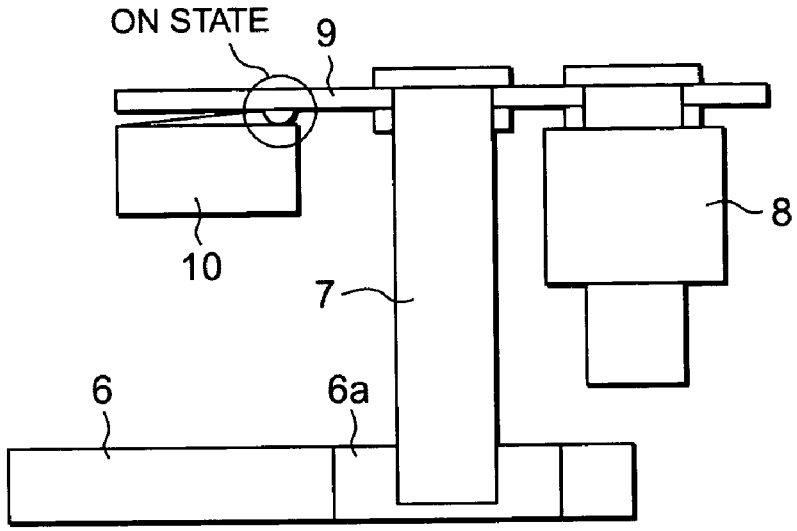
FIGS. 6A and 6B are structural views of a lock device, FIG. 6A showing a locked state and FIG. 6B showing an unlocked state.
Figure 6B:
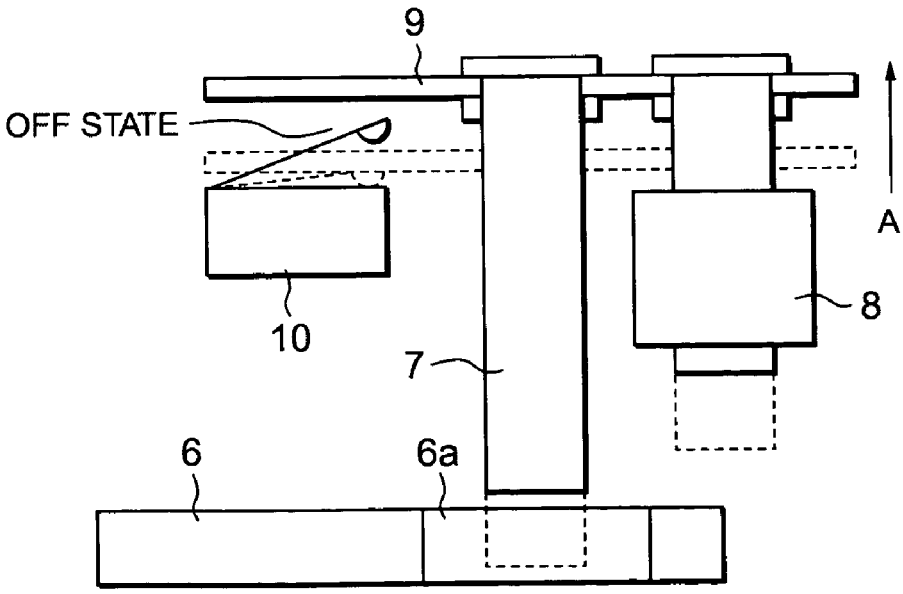
Figure 7:
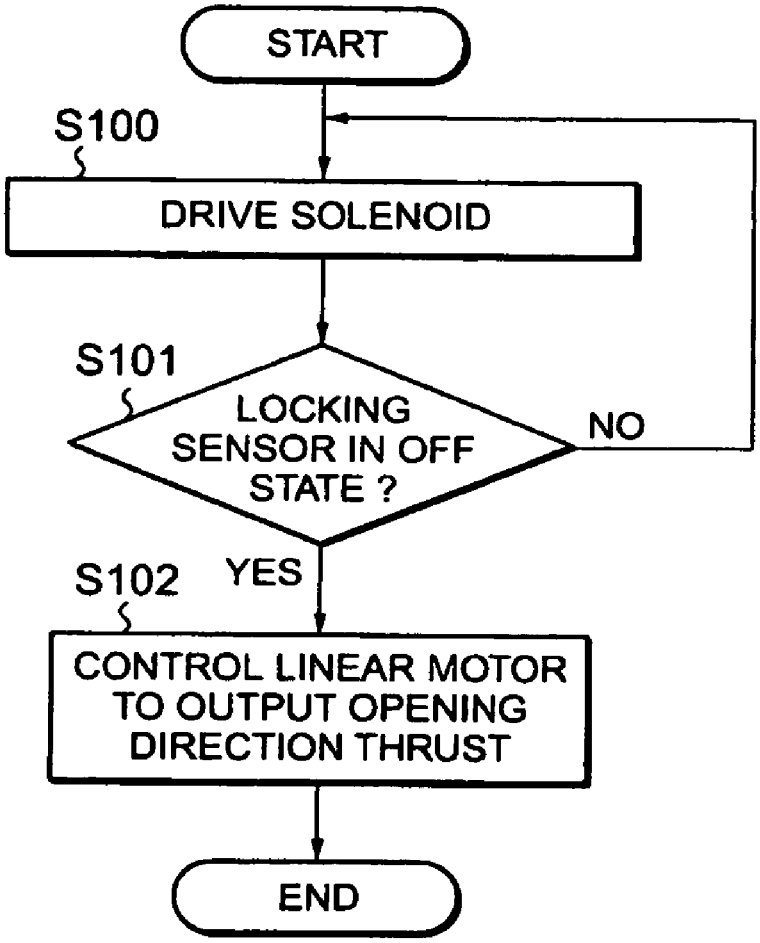
Fig.7 PRIOR ART
FIG. 7 is a flow chart showing a control algorithm for opening a door of the prior art.
Figure 8:
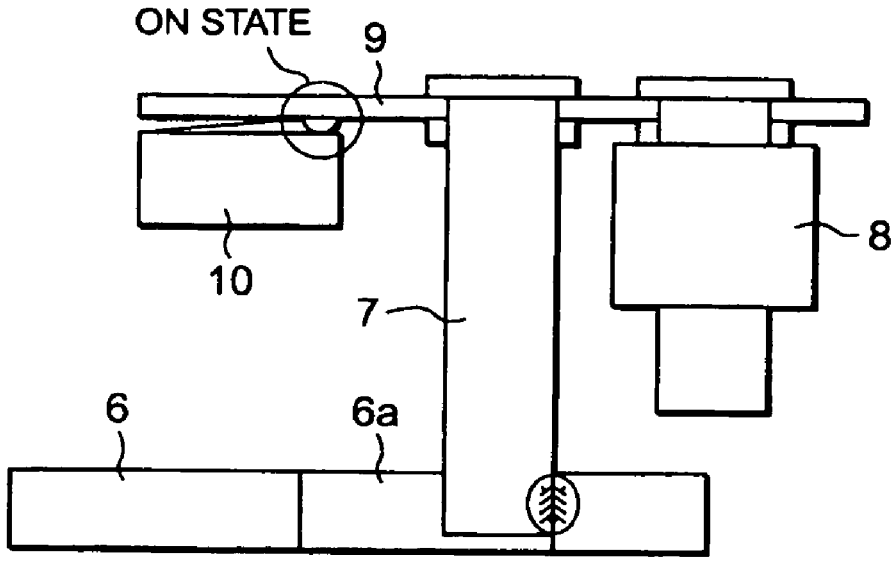
Fig.8 PRIOR ART
FIG. 8 is a view illustrating a problem with a lock device.

The construction of the door apparatus of this preferred embodiment of the invention is the same as the construction of the door apparatus shown in FIGS. 5A and 5B and the lock device 3 shown in FIGS. 6A and 6B, but the control algorithm of the control unit 4 has been improved. Accordingly, the duplicate construction of the door apparatus will not be described below, and only the new control algorithm will be described, with reference also to FIGS. 5A, 5B and FIGS. 6A, 6B.

When a door opening instruction outputted from a control part (not shown) is inputted to the control unit 4, the control unit 4 starts control to perform an opening operation on the closed door 1 (see FIG. 5A). In this case, it will be assumed that the lock device 3 locks the door 1 (see FIG. 6A).

The control unit 4, as shown in the flow chart of FIG. 1, outputs a drive signal to the solenoid 8 to excite the solenoid 8 (step S1), and, immediately after outputting this drive signal, starts timing a detection time (step S2). It then determines whether or not the locking sensor 10 is in its OFF state. That is, the control unit 4 determines whether or not the locking sensor 10 has shifted from its ON state (corresponding to the locked state of the lock device 3) to its OFF state (corresponding to the unlocked state of the lock device 3) and outputted an OFF-state signal (step S3). It also determines whether or not the detection time has reached a set time (step S4). As long as the locked state continues, steps S1 through S4 are repeated.

While steps S1 through S4 are being repeated, when due to the excitation of the solenoid 8 the locking pin 7 withdraws from the lock hole 6*a*, the OFF-state signal is outputted from the locking sensor 10, and in step S3 the OFF state (i.e. the unlocked state of the lock device) is detected and processing jumps to step S5. The control unit 4 then controls the linear motor 2 to apply a thrust force to the door 1 in the opening direction to open the door 1 (step S5). As a result, the door 1 opens and assumes an open state as shown in FIG. 5B. This is the normal processing flow.

If, however, a state continues wherein the locking pin 7 and the boundary surface of the lock hole 6*a* are in contact and unlocking cannot be carried out due to frictional force, and consequently in step S4 the detection time reaches the set time (i.e. the control unit determines that unlocking cannot be carried out), processing jumps to step S6. The control unit 4 then controls the linear motor 2 to apply a thrust force to the door 1 tending to close the door 1 (that is, a force tending to move the lock hole 6*a* along with the door 1 so that the frictional force between the boundary of the lock hole 6*a* and the locking pin 7 decreases) (step S6). As a result, either the lock hole 6*a* moves and the locking pin 7 and the boundary of the lock hole 6*a* move out of contact, or they remain in contact but the frictional force is decreased.

Processing then returns to step S1. The solenoid 8 is then excited and the locking pin 7 withdraws from the lock hole 6*a* before the lock device 3 is unlocked. Thereafter, the door 1 opens in accordance with the procedure described above (step S2, step S3, step S5).

Although in this preferred embodiment the linear motor 2 is controlled to apply a thrust force to the door 1 tending to close the door 1 when unlocking is not effected, conversely the linear motor 2 may be made to apply a thrust force to the door 1 tending to open the door 1. Thus, whether the thrust force is in the closing direction or the opening direction can be suitably decided in accordance with pertaining circumstances.

With a door apparatus like this, when the lock device 3 has not performed the unlocking operation even after the set time has elapsed, the door driving apparatus is controlled to apply a thrust force to the door 1 in the closing direction or the opening direction of the door 1. As a result, either the locking pin 7 and boundary of the lock hole 6*a* are brought into a non-contacting state, or the frictional force between them is reduced. Then the unlocking operation is carried out again to effect unlocking. By this means, use of a solenoid 8 with a large thrust becomes unnecessary, and increases in the size and cost of the equipment can be avoided.

Figure 2:
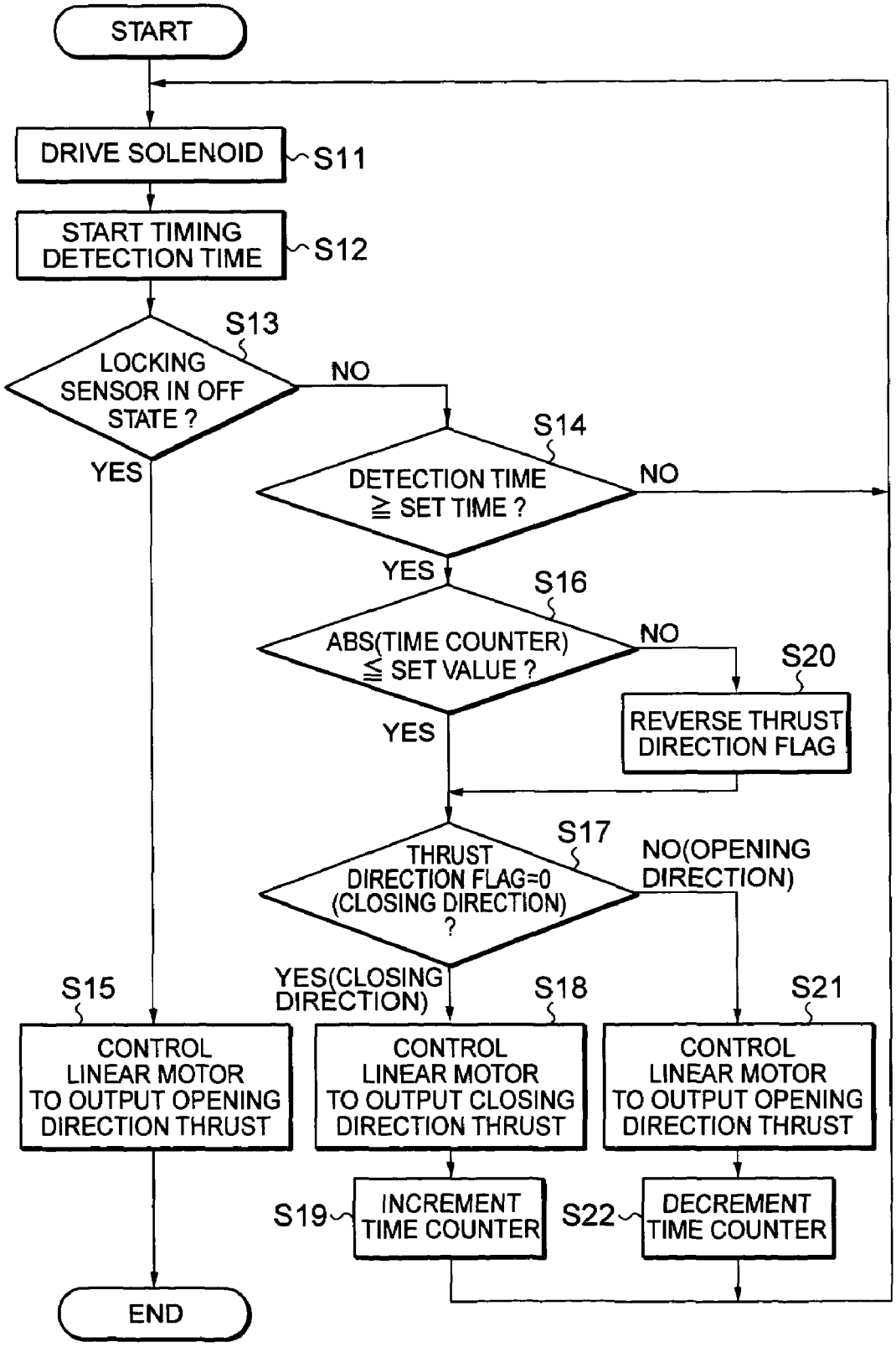
FIG. 2 is a flow chart of a control algorithm of a second preferred embodiment of a door apparatus according to the invention.

A second preferred embodiment of a door apparatus according to the invention now will be described. FIG. 2 is a flow chart of a control algorithm of a second preferred embodiment of a door apparatus according to the invention.

In this preferred embodiment, as in the first preferred embodiment, the construction of the door apparatus is the same as that of the prior art described above. However, the control algorithm of the control unit 4 is different from that of the first preferred embodiment. Accordingly, the duplicate construction of the door apparatus will not be described below, and only the new control algorithm will be described with reference also to FIGS. 5A, 5B and FIGS. 6A, 6B.

The control unit 4 receives a door opening instruction outputted from a control part (not shown), and commences control to perform an opening operation on the closed door 1 (see FIG. 5A). In this case, it will be assumed that the lock device 3 locks the door 1 (see FIG. 6A).

As shown in the flow of FIG. 2, the control unit 4 outputs a drive signal to the solenoid 8 to excite the solenoid 8 (step S11), and immediately after outputting this drive signal, starts timing a detection time (step S12). It then determines whether or not the locking sensor 10 is in its OFF state. That is, the control unit 4 determines whether or not the locking sensor 10 has shifted from its ON state (corresponding to the locked state of the lock device 3) to its OFF state (corresponding to the unlocked state of the lock device 3) and outputted an OFF-state signal (step S13). It also determines whether or not the detection time has reached a set time (step S14). As long as the locked state continues, these steps S11 through S14 are repeated.

While steps S11 through S14 are being repeated, if due to the excitation of the solenoid 8 the locking pin 7 withdraws from the lock hole 6*a*, in step S13 the OFF-state signal is outputted from the locking sensor 10 and the OFF state (i.e. unlocked state of the lock device 3) is detected and processing jumps to step S15. The control unit 4 then controls the linear motor 2 to apply a thrust force to the door 1 in the opening direction (step S15). As a result, the door 1 opens and assumes an open state as shown in FIG. 5B. This is the normal processing flow.

However, if a state such that the locking pin 7 and the boundary of the lock hole 6*a* are in contact and unlocking cannot take place due to frictional force continues, and in step S14 the detection time has reached the set time (that is, it has been determined that unlocking is not possible), processing jumps to step S16.

The control unit 4 determines whether or not ABS (the absolute value of a time counter) is equal to or less than a set value (step S16). For example, if the set value is n and the initial value of the time counter is −n, the absolute value (n) of the time counter is equal to or below the set value (n) and processing proceeds to step S17.

The control unit 4 then determines whether or not a thrust direction flag is 0 (step S17), and, if the flag is 0, controls the linear motor 2 to apply a thrust force to the door 1 in the closing direction to move the door 1 in the closing direction (step S18). Thereupon, the linear motor 2 moves the lock hole 6*a* together with the door 1 and shifts the lock hole 6*a* so that the locking pin 7 and the boundary of the lock hole 6*a* are out of contact. As a result, either the lock hole 6*a* moves, and the locking pin 7 and the boundary of the lock hole 6*a* move out of contact, or they remain in contact but the frictional force is decreased. Then, the time counter is incremented (step S19), and processing jumps to step s11. In step S11, when the solenoid 8 is excited, the locking pin 7 withdraws from the lock hole 6*a*, and the lock device 3 unlocks. Thereafter, the procedure explained above (step S13, step S14) is carried out and the door 1 opens.

However, when the door 1 still fails to open, steps S11 through S19 are repeated, and during this time the linear motor 2 applies a thrust force to the door 1 in the closing direction and the solenoid 8 is excited and the unlocking operation is carried out repeatedly. While steps S11 through S19 are being repeated, the time count also increases.

For example, if the initial value of the time counter has increased from −n to n+1, in step S16 the control unit 4 determined that the absolute value (n+1) of the time counter is not equal to or less than the set value (n), and processing jumps to step S20 and inverts the flag from 0 to 1. When in step S17 the control unit 4 determines that the flag is at 1, processing proceeds to step S21. At step S21, the linear motor 2 is controlled to apply a thrust force to the door 1 in the opening direction to move the door 1 in the opening direction. The lock hole 6*a* and the locking pin 7 are moved so that the locking pin 7 and boundary of the lock hole 6*a* are out of contact with each other. After this, the time counter is decremented (step S22) and processing jumps to step S11. If the solenoid 8 then is excited, the locking pin 7 withdraws from the lock hole 6*a* and the lock device 3 unlocks. Thereafter, the procedure described above (step S13, step S15) is carried out and the door 1 opens.

If, however, the door 1 still fails to open, steps S11 through S17, step S21 and step S22 are repeated, and the time count decreases. During this time, the linear motor 2 continues to apply a thrust force to the door 1 in the opening direction.

Then, while steps S11 through S17, step S21 and step S22 are repeated, the time count decreases. The control unit 4 then determined that the absolute value of the time count is not equal to or less than the set value (step S16). Processing then jumps to step S20 and inverts the flag to 0. When in step S17 the control unit determines that the flag is 0, processing proceeds to step S18, and the linear motor 2 is controlled to apply a thrust force to the door 1 in the closing direction to move the door 1 in the closing direction. By the control unit 4 thereafter repeating this control, the linear motor 2 is controlled to output opening direction and closing direction thrusts alternately.

With this door apparatus, when the lock device 3 still has not performed the unlocking operation after the set time has elapsed, first control is carried out to apply a thrust force to the door 1 in the closing direction of the door 1 to move the locking pin 7 and boundary of the lock hole 6*a* out of contact with each other. The unlocking operation is then carried out to effect unlocking. When unlocking is still not possible, reversely, control is then carried out to apply a thrust force to the door 1 in the opening direction of the door 1 to move the locking pin 7 and boundary of the lock hole 6*a* out of contact with each other. The unlocking operation is then carried out and unlocking is effected. Although in this preferred embodiment the alternation was carried out in the order of closing direction→opening direction→ . . . , it may be carried out in the order opening direction→closing direction→ . . . .

Because in this preferred embodiment the linear motor outputs thrusts alternately in the opening direction and the closing direction so that unlocking can be effected without fail, it becomes unnecessary to use a solenoid 8 with a large thrust, and increases in the size and cost of the equipment can be avoided.

Figure 3:
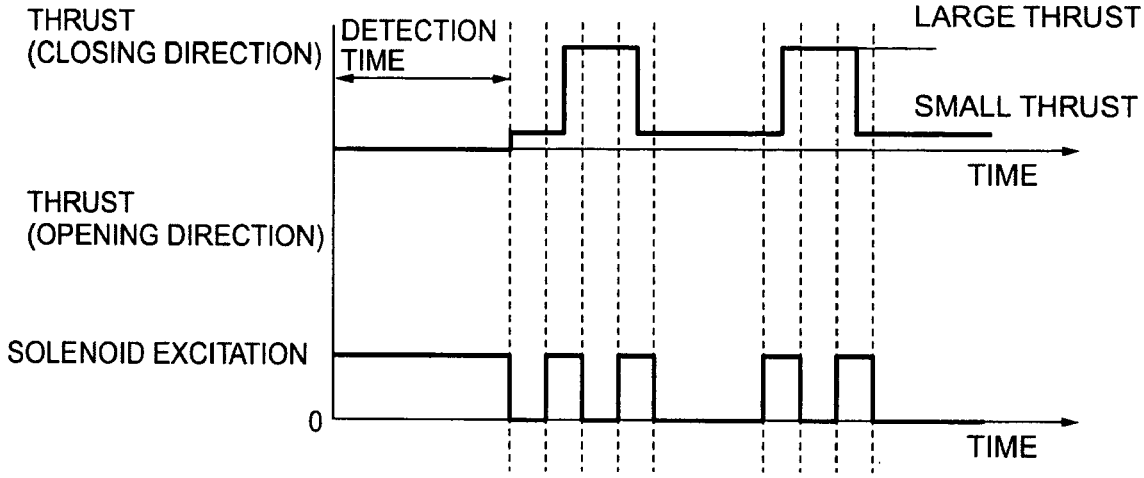
FIG. 3 is a timing chart of linear motor thrust output and solenoid excitation pertaining to a third preferred embodiment of the invention.

A third preferred embodiment of the invention now will be described. FIG. 3 is a timing chart of output of linear motor thrust and solenoid excitation according to this preferred embodiment.

This preferred embodiment includes an improvement of the control algorithm of the control unit 4 of the door apparatus of the first preferred embodiment relating to the output of thrust by the linear motor 2 and the excitation of the solenoid 8. The duplicate construction of the door apparatus will not be described in the following, and only the new control algorithm will be described with reference also to FIGS. 5A, 5B and FIGS. 6A, 6B.

In the flow of FIG. 1 described above, in the outputting of thrust by the linear motor 2 (step S6) and the excitation of the solenoid 8 of the lock device 3 (step S1), control is carried out with the timing shown in FIG. 3.

In this case, the control unit 4 controls the linear motor 2 to apply alternately a large thrust force and a small thrust force as a thrust force on the door 1 in one direction. Specifically, as shown in FIG. 3, alternating thrusts are outputted as follows: small thrust→large thrust→small thrust→large thrust→ . . . . The control unit 4 also excites and controls the solenoid 8 to perform the unlocking operation in synchrony with the timing at which the small thrust changes over to the large thrust and the timing at which the large thrust changes over to the small thrust.

The above-mentioned changeover timing is the timing at which the holder part 6 moves along with the movement of the door 1, and the locking pin 7 and boundary of the lock hole 6*a* move out of contact or remain in contact but undergo a reduction in frictional force, and by carrying out the unlocking operation in synchrony with this timing the unlocking is carried out with more certainty.

Figure 4:
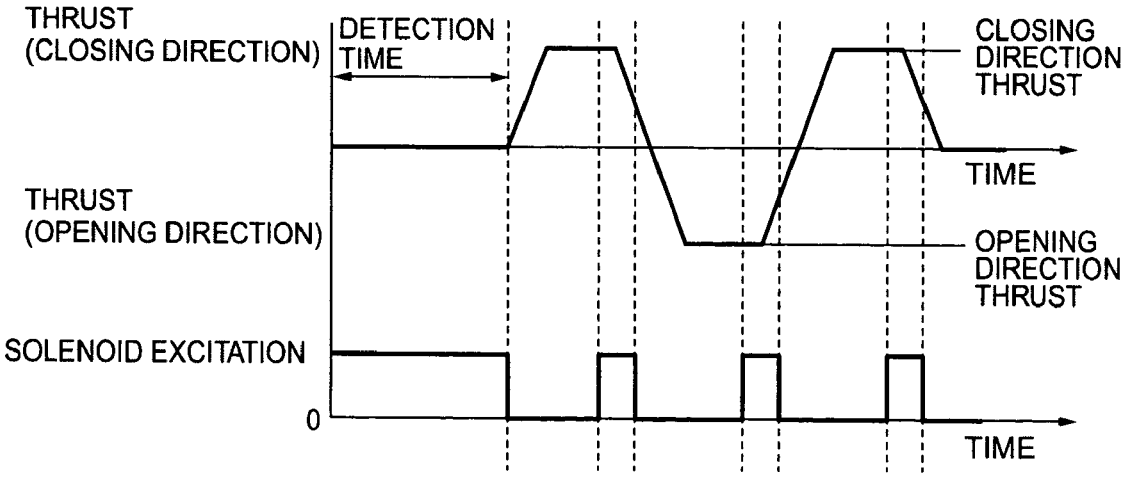
FIG. 4 is a timing chart of linear motor thrust output and solenoid excitation pertaining to a fourth preferred embodiment of the invention.

A fourth preferred embodiment of the invention will now be described. FIG. 4 is a timing chart of output of linear motor thrust and solenoid excitation according to this preferred embodiment.

This preferred embodiment includes an improvement of the control algorithm of the control unit 4 of the door apparatus of the second preferred embodiment relating to the application of thrust by the linear motor 2 and the excitation of the solenoid 8. The duplicate construction of the door apparatus will not be described again in the following, and only the new control algorithm will be described with reference also to FIGS. 5A, 5B and FIGS. 6A, 6B.

In the flow of FIG. 2 described above, in the excitation of the solenoid 8 (step S11) after a closing direction thrust is output from the linear motor 2 (step S18) or an opening direction thrust is output from the linear motor 2 (step S21), the control unit 4 executes control to implement the timing shown in FIG. 4.

In this case, the control unit 4 controls the linear motor 2 to apply alternately a closing direction thrust force and an opening direction thrust force as a thrust force on the door 1. Specifically, as shown in FIG. 4, alternating thrusts are applied as follows: closing direction thrust→opening direction thrust→closing direction thrust→opening direction thrust→ . . . . Because the thrust reversals cannot be carried out instantaneously, they are changed gradually (along sloping lines like those shown in FIG. 4).

The control unit 4 also drives and controls the solenoid 8 to perform the unlocking operation in synchrony with the timing at which the closing direction thrust starts to change over to the opening direction thrust and the timing at which the large opening direction thrust starts to change over to the closing direction thrust.

The above-mentioned changeover timing is the timing at which the holder part 6 moves along with the movement of the door 1 and the locking pin 7 and the boundary of the lock hole 6*a* move out of contact or remain in contact but undergo a reduction in frictional force. By carrying out the unlocking operation in synchrony with this timing, the unlocking is carried out with more certainty.

As described above, according to the first preferred embodiment, when due to positional deviation a frictional force acts between the locking pin 7 and the boundary of the lock hole 6*a* when the linear motor 2 applies a thrust force to the door 1 in one direction (the closing direction) and moves the door 1, the lock hole 6*a* and the locking pin 7 both are moved closer to the center position, and either the locking pin 7 and the boundary of the lock hole 6*a* move out of contact with each other, or they remain in contact but the frictional force between them decreases, and consequently it becomes possible easily to carry out the unlocking operation even if the thrust of the solenoid 8 is small.

In addition, according to the second preferred embodiment, when due to positional deviation a frictional force acts between the locking pin 7 and the boundary of the lock hole 6*a*, while the linear motor 2 applies thrust forces in both directions and moves the door 1 in both directions, the lock hole 6*a* and the locking pin 7 both move closer to the center position, and either the locking pin 7 and the boundary of the lock hole 6*a* move out of contact with each other, or they remain in contact but the frictional force between them decreases, and consequently it becomes possible easily to carry out the unlocking operation even if the thrust of the solenoid 8 is small.

In addition, when due to positional deviation, a frictional force acts between the locking pin 7 and the boundary of the lock hole 6*a*, there is a risk that the boundary surface of the lock hole 6*a* will be pressed against the locking pin 7 if the linear motor 2 pushes continuously with a fixed thrust force. The third preferred embodiment responds in such a situation to avoid this risk by causing the thrust force of the linear motor 2 to change between two different magnitudes so that the boundary surface of the lock hole 6*a* is not continuously pushed strongly against the locking pin 7.

If the solenoid 8 is continuously excited, the current also will decrease due to a resistance increase caused by a temperature increase, and the thrust will fall. To prevent this, by synchronizing the excitation of the solenoid 8 with the timing of the changing over of the thrust force applied by the linear motor 2 between large and small magnitudes, the influence of frictional force between the locking pin 7 and the boundary of the lock hole 6*a* is moderated, and it is made possible easily to effect the unlocking operation.

According to the fourth preferred embodiment, when a frictional force acts due to a positional deviation between the lock hole 6*a* and the locking pin 7, the linear motor 2 also applies thrust forces in both the closing direction and the opening direction, and the excitation of the solenoid 8 is carried out in synchrony with the timing of the thrust changeover of the linear motor 2. Thereby, the influence of frictional force between the locking pin 7 and the boundary of the lock hole 6*a* is moderated, and it is made possible easily to effect the unlocking operation.

Overall, according to the invention it is possible to provide a door apparatus with which, even when the locking pin and the lock hole interfere, the unlocking operation can be performed without the thrust of the solenoid being increased. Moreover, the solenoid can be reduced in size and weight and prevented from overheating.

What is claimed is:

1. A door apparatus, comprising:

a door movable in opposite opening and closing directions;

a door driving device that applies a thrust force to the door to move the door;

a lock device that performs a locking operation and an unlocking operation on the door; and a control means that controls the door driving device and the lock device, wherein, the control means controls the lock device to perform the unlocking operation, and thereafter when the lock device is determined to be still in a locked state even after a set time, the control means controls the lock device to perform the unlocking operation while controlling the door driving device to output a thrust in at least one of the opening direction and the closing direction, to unlock the door.

2. A door apparatus according to claim 1, wherein, when the control apparatus controls the lock device to perform the unlocking operation and the lock device is thereafter determined still to be in a the locked state after the set time, the control apparatus controls the lock device to perform the unlocking operation while controlling the door driving device to output the thrust in both the opening direction and the closing direction.

3. A door apparatus according to claim 2, wherein the control apparatus controls the door driving device to output a thrust in the opening direction and a thrust in the closing direction alternately, and controls the lock device to perform the unlocking operation in synchrony with the timing of the changing of these opening direction and closing direction thrusts.

4. A door apparatus according to claim 2, wherein the lock device includes mechanical locking elements and an electrical means for disengaging the locking elements to open the lock device.

5. A door apparatus according to claim 2, wherein the control apparatus includes a sensor for sensing an unlocked state of the lock device, the control apparatus, while controlling the lock device to perform the unlocking operation, determining whether the sensor senses the unlocked state device before a detection time reaches the set time, and if not controls the door driving device to output a thrust in the opening direction and in the closing direction.

6. A door apparatus according to claim 2, wherein the lock device includes engagable mechanical locking elements and an electrical means for disengaging the locking elements to open the lock device.

7. A door apparatus according to claim 1, wherein the control apparatus controls the door driving device to output a large thrust and a small thrust alternately in the same direction, and controls the lock device to perform the unlocking operation in synchrony with the timing of the changing of the large and small thrusts.

8. A door apparatus according to claim 1, wherein the lock device includes mechanical locking elements and an electrical means for disengaging the locking elements to open the lock device.

9. A door apparatus according to claim 1, wherein the control apparatus includes a sensor for sensing an unlocked state of the lock device, the control apparatus, while controlling the lock device to perform the unlocking operation, determining whether the sensor senses the unlocked state device before a detection time reaches the set time, and if not controls the door driving device to output a thrust in either the opening direction or the closing direction.

10. A door apparatus according to claim 1, wherein the control apparatus further controls the lock device to perform a locking operation, the control apparatus determining whether the lock device is still in a locked state after a set time from an initiation of the unlocking operation, and if the lock device is determined to be in the locked state after the set time, the control apparatus controls the lock device to continue to perform the unlocking operation while controlling the door driving device to output the thrust force in the at least one of the opening direction and the closing direction.

11. A door apparatus according to claim 10, wherein the control apparatus includes a sensor for sensing an unlocked state of the lock device, the control apparatus, while controlling the lock device to perform the unlocking operation, determining whether the sensor senses the unlocked state device before a detection time reaches the set time, and if not controls the door driving device to output alternate thrusts in the opening direction and the closing direction.

12. A door apparatus according to claim 10, wherein the control apparatus includes a sensor for sensing an unlocked state of the lock device, the control apparatus, while controlling the lock device to perform the unlocking operation, determining whether the sensor senses the unlocked state of the lock device before a detection time reaches the set time, and if not controls the door driving device to output a thrust in either the opening direction or the closing direction.

13. The door apparatus according to claim 1, wherein the lock device has a lock pin moveable in a direction normal to a direction of the thrust force.

14. The door apparatus according to claim 1, wherein the control means includes;

lock device controlling means for controlling the lock device to perform the unlocking operation;

checking means for determining whether the door is locked after an initiation of the unlocking operation by the lock device controlling means; and door driving device controlling means, responsive to a determination by the checking means that the door remains locked after a set time from an initiation of the unlocking operation by the lock device controlling means, for controlling the door driving device to apply the thrust force to the door while the lock device controlling means continues to control the lock device to perform the unlocking operation so as to reduce a force resisting completion of the unlocking operation to unlock the door.

15. The door apparatus according to claim 1, wherein the lock device includes a locking pin and a lock hole, the locking pin in the lock hole when the lock device is in the locked state, the thrust applied after the set time relieving a force between the locking pin and an edge of the lock hole resisting removal of the locking pin from the lock hole.

16. A door apparatus according to claim 1, wherein the control means causes the door driving device to jiggle the door during the unlocking operation when the lock device is determined to be in the locked state even after the set time.

17. A door apparatus, comprising:

a door movable in opposite opening and closing directions between an open position and a closed position;

a lock device that performs a locking operation and an unlocking operation on the door while the door is in the closed position; and a door driving device that applies a thrust force to the door in at least one of the opening and closing directions while the door is locked; and a control apparatus that controls the door driving device and the lock device, including lock device controlling means that controls the lock device to perform the unlocking operation;

checking means that determines whether the door is locked after an initiation of the unlocking operation by the lock device controlling means; and means, responsive to a determination by the checking means that the door remains locked after a set time from the initiation of the unlocking operation by the lock device controlling means, that controls the door driving device to apply the thrust force to the door while the lock device controlling means continues to control the lock device to perform the unlocking operation.

18. The door apparatus according to claim 17, wherein the lock device includes a locking pin and a lock hole, the locking pin in the lock hole when the lock device is in the locked state, the thrust applied after the set time relieving a force between the locking pin and an edge of the lock hole that resists removal of the locking pin from the lock hole.

19. The door apparatus according to claim 17, wherein the lock device includes a locking pin and a lock hole, the locking pin in the lock hole when the lock device is in the locked state, the thrust applied after the set time relieving a frictional force in the lock device that resists removal of the locking pin from the lock hole.

20. A door apparatus, comprising:

a door movable in opposite opening and closing directions between an open position and a closed position;

a lock device, that performs locking and unlocking operations on the door while the door is in the closed position to switch a state of the lock device between a locked state in which the door is locked and an unlocked state in which the door is unlocked;

a door driving device, the door driving device having door driving means that applies a first thrust force to the door in at least one of the opening and closing directions while the lock device is in the locked state, and that applies a second thrust force to the door in the opening direction to open the door while the lock device is in the unlocked state, the door driving device being ineffective to open the door when the lock device is in the locked state; and a control apparatus that controls the door driving device and the lock device, wherein the control apparatus controls the lock device to perform the unlocking operation and controls the door driving means to apply the first thrust force, the control apparatus determining whether the lock device still is in the locked state after a set time from an initiation of the unlocking operation, and when the lock device is determined to be in the locked state after the set time, the control apparatus controls the lock device to continue to perform the unlocking operation while controlling the door driving means to output the first thrust force so as to relieve a resistance to the unlocking during the unlocking operation.

21. The door apparatus according to claim 20, wherein the lock device includes a locking pin and a lock hole, the locking pin in the lock hole when the lock device is in the locked state and removed from the lock hole in a direction normal to the thrust force when the lock device is in the unlocked state, the thrust force applied after the set time relieving a frictional force in the lock device, that resists removal of the locking pin from the lock hole.

* * * * *